United States Patent [19]

Daugherty

[11] Patent Number: 4,554,691

[45] Date of Patent: Nov. 26, 1985

[54] PATIENT LIFTING APPARATUS

[76] Inventor: Robert O. Daugherty, R.R. #9, Box 46, Nip St., West Acres Addition, Muncie, Ind. 47302

[21] Appl. No.: 547,981

[22] Filed: Nov. 2, 1983

[51] Int. Cl.[4] ..... B66C 23/16

[52] U.S. Cl. ..... 5/81 R; 318/16; 318/625

[58] Field of Search ..... 5/81 R; 318/16, 51, 318/53, 54, 112, 256, 264–266, 466, 467, 625

[56] References Cited

U.S. PATENT DOCUMENTS

| | | | |
|---|---|---|---|
| 2,787,746 | 4/1957 | Redmond | 318/625 X |
| 3,203,009 | 8/1965 | Lundberg | 5/81 R |
| 3,407,413 | 10/1968 | James | 5/81 R |
| 3,504,122 | 3/1970 | Ratliff, Jr. | 318/16 X |
| 3,576,482 | 4/1971 | Rhee | 318/16 |
| 3,728,606 | 4/1973 | Finnegan et al. | 318/54 X |
| 4,038,590 | 7/1977 | Knowlton | 318/16 X |
| 4,144,713 | 3/1979 | Clark et al. | 5/81 R X |
| 4,183,106 | 1/1980 | Grimes et al. | 5/81 R X |

*Primary Examiner*—Bernard Roskoski
*Assistant Examiner*—W. E. Duncanson,Jr.
*Attorney, Agent, or Firm*—J. David Haynes

[57] ABSTRACT

Lift apparatus by which invalids are translated into various positions through the use of a radio-controlled mechanism operable by the invalid from the lift transport platform. Linear actuators responsive to the radio control network operate to position a rotatable vertical member upon which there is mounted a cantilevered member which is also responsive to a linear actuator. The linear actuators have extendable rams which permit the cantilevered member which supports the invalid transport platform to be positioned in any of myriad locations.

17 Claims, 4 Drawing Figures

PATIENT LIFTING APPARATUS

PRIOR ART

U.S. Pat. Nos. 4,133,437 to Gates, 4,075,719 to Sullivan, 3,940,808 to Bartholomew, 3,877,421 to Brown, 3,694,829 to Bakker and 2,725,093 to Saelene all represent various chair lift devices or patient lift devices for moving invalids from one location to another. Many of these require an assistant to be present to operate the unit and fail to offer any means by which the patient may himself operate the device.

BACKGROUND OF THE INVENTION

This invention relates to an apparatus for transporting invalids within a confined area. There are available numerous devices for effecting movement of patients who are otherwise classified as invalids. Most of the prior art devices permit the patient to be raised or lowered and also permit the patient to be swiveled about a vertical support member. As disclosed in U.S. Pat. 2,725,093 to Saelene the apparatus, while being able to move a patient vertically as well as circumferentially, it is necessary that an operator always be present when the apparatus is in use. Other efforts to provide a patient lifting apparatus are very complex as is illustrated by U.S. Pat. No. 3,694,829 to Bakker. The area of travel into which the lift apparatus may place the patient is limited. In many prior art devices it is not possible to permit the patient to be lowered below floor level as in the case of placing a patient in a whirlpool or bathtub that is below floor level. Exemplary of such a device would be U.S. Pat. No. 3,877,421 to Brown.

With today's high cost of labor, it becomes increasingly important that certain patients who are not totally incapacitated be able to operate the lift devices on their own volition. This eliminates the need for an attendant to be constantly present when the apparatus is being used. As can be seen from a review of the above-referenced patents, the particular mechanical structure used to cause the lift platforms or chairs to be moved is somewhat limited in its realm of travel; many permit the lift to be merely raised or lowered and do not provide for circular motion. Reference may be had to U.S. Pat. No. 3,940,808 to Bartholomew for such a device which also does not permit the patient to be lowered below floor level.

A similar device is shown in U.S. Pat. No. 4,075,719 to Sullivan which, once again, requires an operator for assistance during use of the apparatus and does not permit articulated movement or placement of the patient carrying platform nor does it permit the patient to be lowered below floor level. More recent patents are devoted to mechanisms for moving wheelchair patients into and out of motorized vehicles such as U.S. Pat. No. 4,133,437 to Gates.

Many of the prior art devices use pinion and gear drives to effect movement of the patient lift apparatus. Others use pneumatic controls.

SUMMARY OF THE INVENTION

The present invention is directed to a patient lift apparatus of the same general type as set forth in the patents cited hereinabove; however, the present invention offers an apparatus which has increased flexability and permits the patient to operate the apparatus to articulate exact placement of the patient into myriad locations, including locations below floor level.

In the present invention, linear actuators are controlled via radio remote control apparatus to cause a vertical member to be rotated about its longitudinal axis which causes a cantilevered member mounted thereon to translate radially about the longitudinal axis. A patient lift apparatus is mounted to and suspended from the end of the cantilevered member. The cantilevered member is raised and lowered by a second linear actuator which is mounted on and rotates with the vertically rotatable member.

The patient is permitted to use the device via a remote radio control unit located adjacent the lift platform. In this manner, the patient may access the unit to cause it to rotate or to raise or lower the platform without an operator being present. Should a power failure result, the linear actuators maintain the lift apparatus in the position it last occupied prior to any power failure. Pneumatics are not used. Instead, the linear actuators have extendable rams which are caused to extend or retract in response to electric motors.

The unit has manual override controls which permit an operator to effect control of the apparatus directly instead of through radio control. The unit may be operated via AC or DC voltage depending on the particular location and the needs of the user.

The therapeutic needs of various types of invalids, necessitates that the unit be capable of placing a patient below floor level as when the patient is submerged in a whirlpool. It is also important that the patient be permitted to use the device without the presence of an operator and without the fear of electrical shock.

The present invention provides an apparatus which may translate the patient below floor level and permit the patient to use the apparatus without fear of electrical shock since he has the ability to control the entire operation of the apparatus via a remote radio control handset operated only on low voltage DC batteries.

The apparatus according to the present invention will remain in its location should a power failure occur. There are no exposed rotating gears in which the patient or the patient's clothing may become entangled.

A principal object of the present invention is to provide a novel and improved lift apparatus which permits the patient to use the apparatus on its own volition to translate himself radially about the vertical support member and to also lower himself below floor level as well as elevate himself substantially above floor level.

It is a further object of this invention to provide an apparatus which may be operated through the use of linear actuators having extendable rams to rotate or lift the various members of the lift apparatus to cause the patient to be put into the desired location.

Another object of this invention is to provide such an apparatus which is relatively simple mechanically while at the same time being reliable and safe in operation.

It is a further object of the present invention to provide mechanical control means which do not permit the lift apparatus to fall or collapse when power to the unit is lost.

Other objects and advantages of this invention will become apparent from the following detailed description of a presently preferred embodiment thereof which is shown in the accompanying drawings in which:

DETAILED DESCRIPTION OF THE PREFERRED EMBODIMENT

Figure 1:
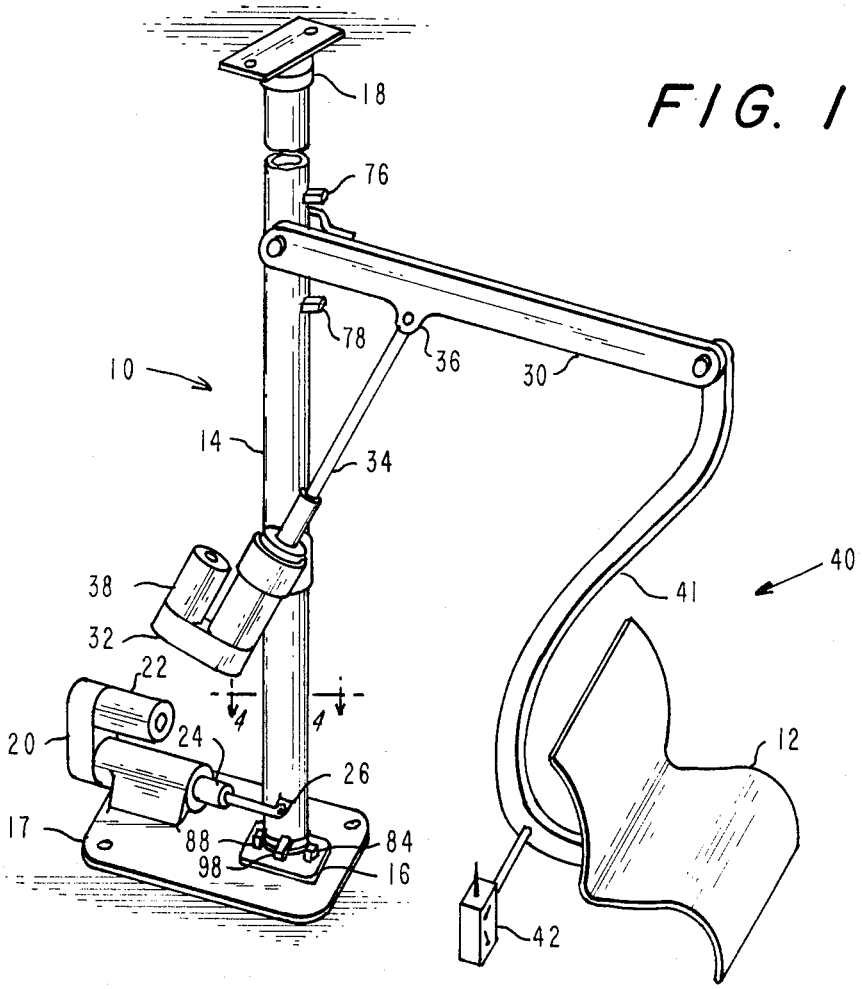
FIG. 1 is a perspective view of a preferred embodiment of the present invention.

In the figures of the drawings, a lift apparatus is broadly indicated by the arrow at numeral 10 in FIG. 1. The lift apparatus permits an invalid to be selectively lifted from one location into yet a different location. The present invention enables the invalid to operate the apparatus while occupying the transport platform 12.

A rotatable vertical support member 14 is pivotially mounted on the floor or a platform. The base of the rotatable vertical support member 14 may be mounted in a bearing 16 to thus permit the vertical member 14 to freely rotate. Also, the vertical member may be rigidly supported between a platform 17 and a ceiling or other support 18 at its top. Likewise, the junction between the vertical support member 14 and its top mounting means 18 may be in the nature of a bearing.

Rotational movement of the vertical support member 14 is effected through a linear actuator 20. The linear actuator is of the type presently available from Saginaw Steering Gear Division, Actuate Products Crew, Saginaw, Michigan. The linear actuator has a solenoid brake 22 for positive positioning of the extendable ram 24. Extendable ram 24 is always locked in its present position except when the electrical motor of linear actuator motor 20 is in an operating mode. The solenoid brake virtually eliminates coasting. Thus, point to point travel along the stroke can be accurately obtained between limit switches 84 and 88.

Connector 26 is located at the outward end of extendable ram 24. In the preferred embodiment, connector 26 is connected in a rotatable and mating relationship with tie rod member 28 (See FIG. 4) to thus impart rotational movement to the rotatable vertical support member 14. Linear actuator 20 may be energized to cause rotatable vertical support member 14 to rotate clockwise or counterclockwise within its range of movement.

A cantilevered member 30 is rotatably connected to the periphery of rotatable support member 14 so that said cantilevered member 30 may be raised and lowered. A second linear actuator 32 is likewise rotatably mounted on the periphery of rotatable vertical support member 14. The extendable ram 34 of said linear actuator 32 has its outmost end rotatably connected with tie rod joint 36. The tie rod joint 36 is an intrical part of the cantilevered member 30. Linear actuator 32 is the same as linear actuator 20 and likewise includes a solenoid brake 38. As the linear actuator is energized the extendable ram 34 thereof extends or retracts at the election of the operator. Extension of the extendable ram 34 raises the cantilevered member 30. Conversely, retraction of the extendable ram 34 effects lowering of the cantilevered member 30. At the outer end of the cantilevered member 30 there is rotatably connected a transport apparatus 40. The transport apparatus 40 includes a longitudinal member 41 which has at the lower end thereof either a chair or similar device 12 for holding an invalid.

Figure 3:
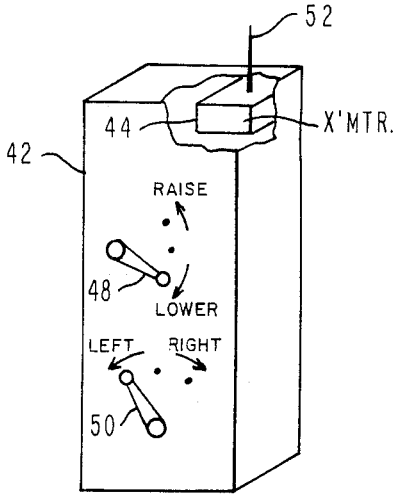
FIG. 3 is a partially cut away elevational view of a typical handset for use by the patient in controlling the present invention.

Referring now to FIG. 3, the radio control handset 42 comprises basic state-of-the-art components. A transmitter 44 transmits one of four (4) different frequencies which are received by receiver 46 (FIG. 2).

Toggle switches 48 and 50 are three (3) positional switches. When the switch is in its neutral position, no signal is generated. When the switch is placed in either of its other two (2) positions, a signal is generated. Switch 48 causes a frequency to be produced which raises the cantilevered member 30 when in its upper position and produces a signal which causes the cantilevered member 30 to be lowered when it is in its lower position.

Similar signals are produced in response to movement left or right of switch 50. Movement of switch 50 to the left causes the vertical support member 14 to be rotated counterclockwise while movement to the right causes vertical support member 14 to rotate clockwise.

Figure 2:
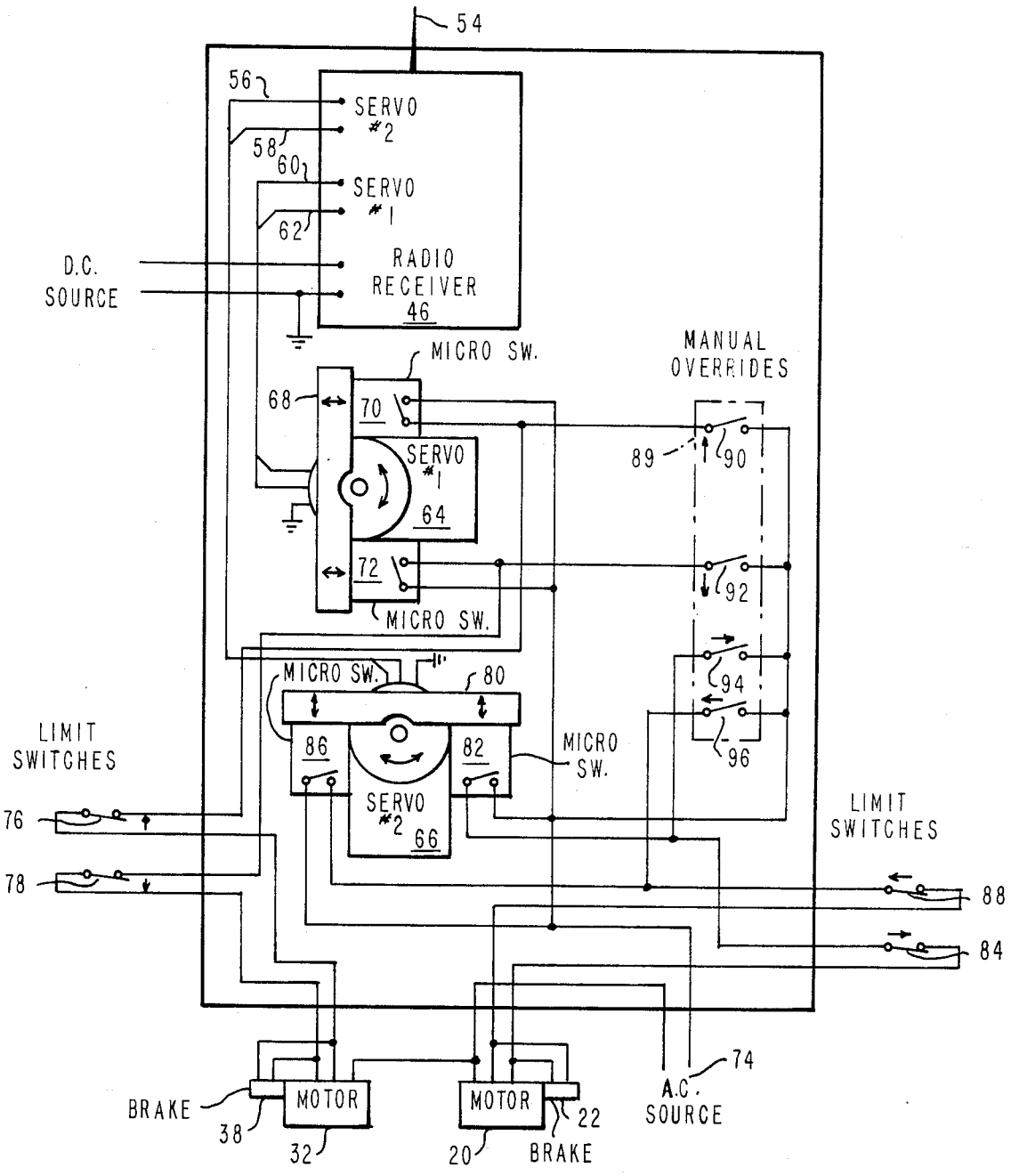
FIG. 2 is a schematic diagram of the electrical control circuitry for effecting movement of the present apparatus.

The signals generated by transmitter 14 are transmitted via antenna 52 and received by antenna 54 (FIG. 2).

Referring now to FIG. 2, there is disclosed the circuitry for responding to the transmitted signals and effecting control of the linear actuators 20 and 32. The signals are received via antenna 54 by receiver 46. Receiver 46 provides at its outputs 56, 58, 60 and 62 voltages responsive to and indicative of the location of switches 48 and 50.

Servomotors 64 and 66 respond to the outputs from receiver 46 to either rotate clockwise or counterclockwise. The servomotors are standard servomotors. Wiper arm 68 on servomotor 64 mates with microswitches 70 and 72. Clockwise movement of wiper arm 68 causes microswitch 70 to close which completes an electrical circuit from alternating current source 74 through limit switch 76 to motor 32. This circuit will cause the cantilevered member 30 to raise.

Counterclockwise movement of wiper arm 68 causes microswitch 72 to close which completes an electrical circuit from alternating current source 74 through limit switch 78 to motor 32 which causes the motor to rotate in a direction opposite to when switch 70 is closed. This circuit causes the cantilevered member 30 to lower.

Motors 22 and 32 are linear actuators with extendable rams (See FIG. 1). As the motors are energized to rotate clockwise or counterclockwise, the rams 24 and 34 are extended or retracted to effect raising or lowering of the cantilevered member 30 and rotation of vertical support member 14.

Similar circuits are provided to motor 20 which causes vertical support member 14 to rotate. As wiper arm 80 rotates clockwise, microswitch 82 closes which causes alternating current to supplied via limit switch 84 to motor 20 to effect clockwise movement of vertical support member 14. When wiper arm 80 rotates counterclockwise, microswitch 86 is closed which provides alternating current via limit microswitch 88 to motor 20 to effect counterclockwise movement of vertical support member 14.

The limit switches 76, 78, 84 and 88 are physically located on the lift apparatus to prevent the over-rotation of vertical support member 14 or over-raising or over-lowering of the cantilevered member 30.

The limit switches 76, 78, 84 and 88 are positionally disclosed in FIG. 1. Limit switches 76 and 78 control or limit the upward and downward movement of cantilevered member 30. Limit switch 76 is positioned above the cantilevered member 30. As the cantilevered member 30 moves upward, the switch is impacted by the upper surface of the cantilevered member to thus cause the switch to open which breaks the circuit to the linear actuator 38 to prevent further upward movement of the cantilevered member 30 which, of course, prevents further extension of extendable ram 34. Conversely, limit switch 78 is positioned beneath cantilevered member 30. As the cantilevered member is lowered, its lower surface will impact limit switch 78 which breaks the circuit or opens the circuit to the motor of linear actuator 38 to thus prevent further retraction of extendable ram and thereby further lowering of the cantilevered member 30.

Similar limit switches 84 and 88 are disposed at the base of vertical support member 14. A wand 98 is affixed to the periphery of vertical support member 14. As vertical support member 14 rotates clockwise or counterclockwise the wand will impact limit switch 84 and limit switch 88, respectively. As the wand impacts the limit switch 88, it causes the circuit to be opened to linear actuator 20 to prevent further counterclockwise rotational movement of vertical member 14. As wand 98 rotates in a clockwise direction the wand will ultimately contact limit switch 84 to cause it to open and thus break the circuit to linear actuator 20 to prevent further clockwise rotational movement of vertical support member 14.

The present invention also has a manual override control for use in lieu of the radio control unit. The manual override panel 89 has four (4) normally open switches 90, 92, 94 and 96. Closing of switch 90 is the same as closing microswitch 70 which causes cantilevered member 30 to raise. Closing of switch 92 is the same as closing microswitch 72 and causes cantilevered member 30 to lower. Closing of switch 94 is the same as closing microswitch 82 and causes vertical support member 14 to rotate clockwise. Closing of switch 96 is the same as closing microswitch 86 and causes vertical support member 14 to rotate counterclockwise.

Brakes 22 and 38 of linear actuators 20 and 32 are engaged to brake or secure inaction of the extendable rams when no power is supplied thereto. When power is supplied to the brakes, they release the extendable rams to permit movement. Thus, the brake circuits are connected in parallel with the circuits to the motors.

Figure 4:
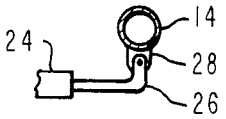
FIG. 4 is a fragmentary top plan view of the connection between the ram of one the linear actuators and the rotatable vertical member of the present invention taken along line 4—4 of FIG. 1.

Referring now to FIG. 4, extendable ram 24 is shown partly cut-away. At its outer end and "L" shaped tie rod 26 is rotatably connected to flange or tie rod 28. Flange 28 is permanently secured to the periphery of vertical support member 14. As the extendable ram 24 extends or retracts, it exerts a force on flange 28 which imparts rotational movement to vertical support member 14.

The foregoing disclosure and description of the invention is illustrative and explanatory thereof, and various changes in the size, shape and materials as well as in the details of the illustrated construction may be made within the scope of the appended claims without departing from the spirit of the invention.

I claim:

1. Lift apparatus by which invalids are translated into various positions, said apparatus comprising:

a rotatable vertical support member having a vertical longitudinal axis;

a vertically rotatable cantilevered member having a first end and a second end, said first end being rotatably secured to said rotatable vertical support member;

a first linear actuator secured to and between said rotatable vertical support member and said cantilevered member, said first linear actuator being rotatably secured to said cantilevered member at a point between the said first end and the said second end of said cantilevered member;

a remote control apparatus for effecting selective varying of the position of said cantilevered member and said vertical support member; and a transport apparatus rotatably connected to said second end of said cantilevered member, whereby said transport apparatus may be elevated and circumferentially translated about the vertical longitudinal axis of said rotatable vertical support member.

2. Lift apparatus as set forth in claim 1 wherein said rotatable vertical support member is rotatably supported by a bearing at its lower end and wherein said lift apparatus further comprises a second linear actuator having an extendable ram connected to the periphery of said rotatable vertical support whereby said rotatable vertical support member is caused to rotate as the said extendable ram of said second linear actuator is extended or retracted.

3. Lift apparatus as set forth in claim 2 wherein said second linear actuator further comprises an electric motor for selectively extending and retracting said extendable ram thereof.

4. Lift apparatus as set forth in claim 2 wherein said first linear actuator comprises an extendable ram and an electric motor, whereby said vertically rotatable cantilevered member is raised and lowered as the extendable ram of said first linear actuator is extended or retracted.

5. Lift apparatus as set forth in claim 4 wherein said first linear actuator further comprises an electric motor for selectively extending and retracting said extendable ram thereof.

6. Lift apparatus as set forth in claim 1 wherein said remote control apparatus further effects selective varying of the position of said rotatable vertical support member.

7. Lift apparatus as set forth in claim 6 wherein said remote control apparatus comprises an operator radio control unit and a radio receiver unit for initiating control signals, said operator radio control unit being removably positioned near said transport apparatus to enable an individual occupying said transport apparatus to selectively use said radio control unit, and said radio receiver unit being affixed to said lift apparatus to initiate dependent control signals to said first and second linear actuators, and wherein said lift apparatus further comprises a second linear actuator having an extendable ram connected to the periphery of said rotatable vertical support whereby said rotatable vertical support member is caused to rotate as the said extendable ram of said second linear actuator is extended or retracted.

8. Lift apparatus as set forth in claim 7 wherein said remote control apparatus further comprises a manual override control panel whereby said first linear actuator and said second linear actuator may be initiated.

9. Lift apparatus as set forth in claim 7 wherein said radio receiver unit further comprises:

a first servo mechanism having a first output and a second output;

a second servo mechanism having a first output and a second output; and a radio receiver for receiving and producing output signals in response to radio signals.

10. Lift apparatus as set forth in claim 2 wherein said remote control apparatus comprises:

a radio control handset for selectively generating up to four discrete signals;

a radio receiver for receiving signals generated by said radio control handset and producing in response thereto a first, a second, a third and a fourth output signal;

a first servomotor having a first input electrically connected to the first output of said radio receiver and having a second input electrically connected to the second output of said radio receiver;

a second servomotor having a first input electrically connected to said third output of said radio receiver and having a second input electrically connected to the fourth output of said radio receiver;

a first wiper bar connected to said first servomotor for movement in synchronism with said servomotor;

a second wiper bar connected to said second servomotor for movement in synchronism with said second servomotor;

a first microswitch and a second microswitch juxaposed to said first servomotor; and a third microswitch and a fourth microswitch juxaposed said second servomotor, wherein said first microswitch and said second microswitch are caused to open and close in direct response to the physical position of said first wiper bar and wherein said third and said fourth microswitches are caused to open and close in direct response to the physical position of said second wiper arm.

11. Lift apparatus set forth in claim 10 wherein said rotatable vertical support member is rotatably supported at its lower end and herein said first linear actuator comprises an electrical motor for rotating clockwise or counterclockwise in response to current supplied thereto and wherein said second linear actuator comprises a motor for rotating clockwise or counterclockwise in response to current applied thereto, said motor of said first linear actuator and said motor of said second linear actuator each having a first and second input terminal, said first input terminal of said first motor being electrically connected to said first microswitch and said second input terminal of said first motor being electrically connected to said second microswitch whereby said first motor is caused to rotate in a first direction when said first microswitch is closed and whereby said first motor is caused to rotate in a different direction when said second microswitch is closed; and wherein the first input of said second motor is connected to said third microswitch and said second input of said second motor is connected to said fourth microswitch whereby said second motor is caused to rotate in a first direction when said third microswitch is closed and whereby said motor is caused to rotate in a second direction when said fourth microswitch is closed, said rotation of said first motor causes the extendable ram of said first linear actuator to be extended or retracted to thus effect raising or lowering of said cantilevered member, said rotation of said second motor causes the extendable ram of said second linear actuator to be extended or retracted to thus effect rotation of said vertical support member.

12. Lift apparatus as set forth in claim 11 wherein said lift apparatus further comprises a first limit switch, a second limit switch, a third limit switch, and a fourth limit switch, said first limit switch being electrically connected in series between said first input of said first motor and said first microswitch, said second limit switch being connected in series between said second input of said first motor and said second microswitch, said third limit switch being connected in series between said first input of said second motor and said third microswitch and said fourth limit switch being connected in series between said second input of said second motor and said fourth microswitch, said first and second limit switches being physically located on said vertical support member whereby said cantilevered member when raised to its utmost position contacts said first limit switch to thus open the circuit between said first microswitch and said first input of said first motor, said second limit switch being mounted on said vertical support member beneath said cantilevered member whereby said cantilevered member contacts said second limit switch to cause it to open and thus break the circuit between said second microswitch and said second input of said first motor when said cantilevered member is in lowermost position; said third limit switch and said fourth limit switches being mounted on said vertical support member and said vertical support member further comprising a wand protuding outwardly from the periphery thereof, said wand contacting said third limit switch when said vertical support member is rotated counterclockwise to its utmost position to thus break the circuit between said third microswitch and said first input of said second motor and said wand contacting said fourth limit switch when said vertical support member is rotated clockwise to its utmost position to thus break the circuit between said fourth microswitch and said second input of said second motor whereby said vertical support member is thus controlled in its clockwise and counterclockwise rotational movement between predetermined limits.

13. Lift apparatus as set forth in claim 12 to further comprise a manual override circuit comprising a first, a second, a third, and a fourth switch, said first switch being electrically connected in parallel to said first microswitch, said second switch being electrically connected in parallel with said second microswitch, said third switch being electrically connected in parallel with said third microswitch, a said fourth switch being electrically connected in parallel with said fourth microswitch, wherein said first, said second, said third, and said fourth switch of said override circuit are physically operable to thus selectively control the operation of said first and second motors of said first and second linear actuators to thereby effect positioning of said cantilevered member and rotation of said vertical support member.

14. Lift apparatus as set forth in claim 7 wherein said remote control apparatus comprises:

a radio control handset for selectively generating up to four discrete signals;

a radio receiver for receiving signals generated by said radio control handset and producing in response thereto a first, a second, a third and a fourth output signal;

a first servomotor having a first input electrically connected to the first output of said radio receiver and having a second input electrically connected to the second output of said radio receiver;

a second servomotor having a first input electrically connected to said third output of said radio receiver and having a second input electrically connected to the fourth output of said radio receiver;

a first wiper bar connected to said first servomotor for movement in synchronism with said servomotor;

a second wiper bar connected to said second servomotor for movement in synchronism with said second servomotor;

a first microswitch and a second microswitch juxaposed to said first servomotor; and a third microswitch and a fourth microswitch juxaposed said second servomotor, wherein said first microswitch and said second microswitch are caused to open and close in direct response to the physical position of said first wiper bar and wherein said third and said fourth microswitches are caused to open and close in direct response to the physical position of said second wiper arm.

15. Lift apparatus set forth in claim 14 wherein said rotatable vertical support member is rotatably supported at its lower end and wherein said first linear actuator comprises an electrical motor for rotating clockwise or counterclockwise in response to current supplied thereto and wherein said second linear actuator comprises a motor for rotating clockwise or counterclockwise in response to current applied thereto, said motor of said first linear actuator and said motor of said second linear actuator each having a first and second input terminal, said first input terminal of said first motor being electrically connected to said first microswitch and said second input terminal of said first motor being electrically connected to said second microswitch whereby said first motor is caused to rotate in a first direction when said first microswitch is closed and whereby said first motor is caused to rotate in a different direction when said second microswitch is closed; and wherein the first input of said second motor is connected to said third microswitch and said second input of said second motor is connected to said fourth microswitch whereby said second motor is caused to rotate in a first direction when said third microswitch is closed and whereby said motor is caused to rotate in a second direction when said fourth microswitch is closed, said rotation of said first motor causes the extendable ram of said first linear actuator to be extended or retracted to thus effect raising or lowering of said cantilevered member, said rotation of said second motor causes the extendable ram of said second linear actuator to be extended or retracted to thus effect rotation of said vertical support member.

16. Lift apparatus by which invalids are translated into various positions, said apparatus comprising:

a rotatable vertical support member having a vertical longitudinal axis;

a vertically rotatable cantilevered member having a first end and a second end, said first end being rotatably secured to said rotatable vertical support member;

a first linear actuator secured to and between said rotatable vertical support member and said cantilevered member, said first linear actuator being rotatably secured to said cantilevered member at a point between the said first end and the said second end of said cantilevered member;

a transport apparatus rotatably connected to said second end of said cantilevered member;

a second linear actuator having an extendable ram connected to the periphery of said rotatable vertical support whereby said rotatable vertical support member is caused to rotate as the said extendable ram of said second linear actuator is extended or retracted.

a control apparatus for effecting selective varying of the position of said cantilevered member and said vertical support member, said control apparatus comprising:

a control circuit for selectively generating up to four discrete signals;

means for receiving said signals and producing in response thereto a first, a second, a third and a fourth output signal;

a first servomotor having a first input electrically connected to the first output of said means for receiving and having a second input electrically connected to the second output of said means for receiving;

a second servomotor having a first input electrically connected to said third output of said means for receiving and having a second input electrically connected to the fourth output of said means for receiving;

a first wiper bar connected to said first servomotor for movement in synchronism with said servomotor;

a second wiper bar connected to said second servomotor for movement in synchronism with said second servomotor; and a first microswitch and a second microswitch juxtaposed to said first servomotor; and a third microswitch and a fourth microswitch juxtaposed said second servomotor, wherein said first microswitch and said second microswitch are caused to open and close in direct response to the physical position of said first wiper bar and wherein said third and said fourth microswitches are caused to open and close in direct response to the physical position of said second wiper arm, whereby said transport apparatus may be elevated and circumferentially translated about the vertical longitudinal axis of said rotatable vertical support member.

17. Lift apparatus as set forth in claim 16 wherein said lift apparatus further comprises a first limit switch, a second limit switch, a third limit switch, and a fourth limit switch, said first limit switch being electrically connected in series between said first input of said first motor and said first microswitch, said second limit switch being connected in series between said second input of said first motor and said second microswitch, said third limit switch being connected in series between said first input of said second motor and said third microswtich and said fourth limit switch being connected in series between said second input of said second motor and said fourth microswitch, said first and second limit switches being physically located on said vertical support member whereby said cantilevered member when raised to its utmost position contacts said first limit switch to thus open the circuit between said first microswitch and said first input of said first motor, said second limit switch being mounted on said vertical support member beneath said cantilevered member whereby said cantilevered member contacts said second limit switch to cause it to open and thus break the circuit between said second microswitch and said second input of said first motor when said cantilevered member is in lowermost position; said third limit switch and said fourth limit switches being mounted on said vertical support member and said vertical support member further comprising a wand protruding outwardly from the periphery thereof, said wand contacting said third limit switch when said vertical support member is rotated counterclockwise to its utmost position to thus break the circuit between said third microswitch and said first input of said second motor and said wand contacting said fourth limit switch when said vertical support member is rotated clockwise to its utmost position to thus break the circuit between said fourth microswitch and said second input of said second motor whereby said vertical support member is thus controlled in its clockwise and counterclockwise rotational movement predetermined limits.

* * * * *